United States Patent [19]

Drake

[11] Patent Number: 4,645,615

[45] Date of Patent: Feb. 24, 1987

[54] FIRE-RESISTANT HYDRAULIC FLUID

[75] Inventor: Harry N. Drake, Fairless Hills, Pa.

[73] Assignee: FMC Corporation, Philadelphia, Pa.

[21] Appl. No.: 833,701

[22] Filed: Feb. 27, 1986

[51] Int. Cl.[4] ..... C10M 105/74; C10M 143/10

[52] U.S. Cl. ..... 252/78.5; 252/49.8; 252/56 R; 252/76; 585/11; 585/428

[58] Field of Search ..... 252/49.8, 56 R, 78.5, 252/76; 585/11, 428

[56] References Cited

U.S. PATENT DOCUMENTS

| | | | |
|---|---|---|---|
| 2,707,176 | 4/1955 | Gamrath et al. | 252/78 |
| 3,115,466 | 12/1963 | Orloff et al. | 252/49.9 |
| 3,554,911 | 1/1971 | Schiff et al. | 252/59 |
| 3,629,114 | 12/1971 | Fairing | 252/49.8 |
| 3,629,120 | 12/1971 | Fairing | 252/78 |
| 3,637,507 | 1/1972 | Gentit | 252/78 |
| 3,707,500 | 12/1972 | Romano et al. | 252/78 |
| 3,723,320 | 3/1973 | Herber et al. | 252/78 |
| 3,761,404 | 9/1973 | Calow et al. | 252/39 |
| 3,941,708 | 3/1976 | Gentit et al. | 252/78 |
| 3,992,309 | 11/1976 | Dounchis | 252/49.8 |
| 4,049,563 | 9/1977 | Burrous | 252/49.9 |
| 4,440,657 | 4/1984 | Metro et al. | 252/49.9 |

FOREIGN PATENT DOCUMENTS 951769 3/1964 United Kingdom .

OTHER PUBLICATIONS

Fattori, "Laboratory and Engine Rheological Aspects of Fuel Efficient Oils," Tribol. Lubr., 1982, 16(4), 148–59, (CA98:56715).

*Primary Examiner*—Robert A. Wax

*Attorney, Agent, or Firm*—R. E. Elden; R. L. Andersen; E. G. Seems

[57] ABSTRACT

A functional fluid composition is provided suitable for high shear applications employing a major amount of a tertiary-butylphenyl/phenyl phosphate and a minor amount of a polyol ester as a base stock and a homopolymer of polystyrene having a molecular weight between 200,000 and 300,000.

9 Claims, No Drawings

FIRE-RESISTANT HYDRAULIC FLUID

This invention relates to improved synthetic phosphate ester functional fluids particularly suitable for use as hydraulic fluids and the like. More particularly, the invention relates to triaryl phosphate ester functional fluid compositions derived from mixtures of tertiary-butylphenyl/phenyl phosphates which exhibit a high viscosity index and a low pour point, and also exhibit good hydrolytic, thermal and oxidative stability, good wear properties, low shear stability, good lubricity and fire-resistance.

The functional fluids of this invention are organic flame-retardant liquid liquid compositions. Many different types of materials are utilized as functional fluids; and functional fluids are used in many different types of applications. Thus, such fluids have been used as electronic coolants, atomic reactor coolants, diffusion pump fluids, lubricants, damping fluids, bases for greases, power transmission and hydraulic fluids, heat transfer fluids, heat pump fluids, refrigeration equipment fluids and as filter mediums for air conditioning systems.

U.S. Pat. No. 3,992,309 to Dounchis teaches functional fluids with exceptional thermal and oxidative stability which employ as a base stock from 10% to 90% by weight of a "mixed t-butylphenyl/phenyl phosphate" and 90% to 10% by weight of organic esters of carboxylic acids with polyol compounds such as pentaerythritol, trimethylolethane and trimethylolpropane, neopentyl glycol esters and the like, the carboxylic acids generally having from about 5 to 10 carbon atoms. Base stocks employing the tertiary-butylphenyl/phenyl phosphate and polyol esters, exhibit good extreme pressure and anti-wear properties. These are desirable properties for a hydraulic fluid, particularly in combination with the unusual degree of thermal stability, and the compatibility of these materials when compounded with minor amounts of additives often used for other functional fluids to improve the properties thereof. However, the compositions of the '309 patent do not have both the high viscosity index and the low pour point together with the otherwise desirable properties.

U.S. Pat. No. 3,629,114 to Fairing discloses that the additive response of a phosphate base stock will vary according to the type of phosphate base stock. That is, the concentration of an ester compound will vary according to whether the phosphate base stock is a trialkyl phosphate, a triaryl phosphate, a mixed alkylaryl phosphate or a mixture of the above phosphate base stocks. This lack of predictability makes it difficult to formulate a phosphate base stock to meet specific requirements of functional fluids.

In general, a phosphate ester functional fluid is sufficiently nonflammable to satisfy requirements for fire resistance. The viscosity characteristics of a functional fluid must be such that it may be used over a wide temperature range; that is, a low rate of change of viscosity with temperature (the viscosity index). Further, its pour point should be low; its volatility should be low at elevated temperatures of use; that is, selective evaporation or volatilization of any important component should not take place at high temperatures of use. It must possess sufficient lubricity and mechanical stability to enable it to be used in hydraulic systems of aircraft which are exceedingly severe on the fluid used. It should be chemically stable to resist such chemical reactions as oxidation and thermal degradation so rthat it will remain stable under conditions of use against loss of desired characteristics, due to high and sudden changes of pressure, temperature, high tensile stresses, and contact with various metals.

The present invention is a shear-stable composition meeting the severe requirements of a functional fluid comprising a mixture of a major amount of a tertiary-butylphenyl/phenyl phosphate ester and a minor amount of a polyol ester pour point depressant as a base stock, and from about 0.1% to 2% of a homopolymer polystyrene having a molecular weight of about 200,000 to about 300,000.

The tertiary-butylphenyl/phenyl phosphate ester is defined as a mixed alkylated phenyl phosphate ester containing between about 15% to 60%, preferably 30% to 50%, by weight mono-t-butylphenyl radicals or mixtures thereof with di-t-butylphenyl radicals, the di-t-butylphenyl radicals being present in an amount between about 1% to 10% by weight based on the weight of the mono-t-butylphenyl radicals. A particularly desirable phosphate ester is commercially available from FMC Corporation under the designation of DURAD® 150-B phosphate hydraulic fluid.

The base stock of the present invention to comprise a major amount (greater than 50% by weight) of a tertiary-butylphenyl/phenyl phosphate ester for fire retardancy and a minor amount (less than 50% by weight) of a polyol ester. Desirably, the base stock comprises between 60% to 90% by weight of the phosphate ester and between 40% and 10% of a polyol ester preferably about 70% to 80% by weight phosphate ester and about 20% to 30% by weight of a polyol ester which functions as a pour point depressant.

The polyol ester incorporated into the base stock can be any polyol ester suitable for use as a synthetic oil, such as esters of polyols and of $C_4$ to $C_{12}$ straight or branched chained monocarboxylic acids. These compounds are prepared by reacting a polyol such as pentaerythritol, dipentaerythritol, tripentaerythritol, trimethylol propane, trimethylol ethane, trimethylol butane, neopentylglycol and the like with carboxylic acids such as butyric acid, valeric acid, isovaleric acid, caproic acid, hexanoic acid, caprylic acid, pelargonic acid, capric acid, lauric acid etc. Particularly good results are obtained with mixed esters of mono- and di-penta-erythritol with $C_5$–$C_{10}$ straight chain carboxylic acids. Exemplary synthetic fluid bases which are commerically available include Hercolube J, Hercolube B, Hercolube A, Hercolube C, all marketed by Hercules Incorp., Unilever 14,636, Unilever 14,735, marketed by Unilever Corp., HATCOL 2377 and HATCOL 2925 marketed by Hatco Chemical Corporation and Stauffer Base stocks 700, 704, 800, marketed by Stauffer Chemical Company. Particularly desirable is an ester prepared from commercial grade pentaerythritol and $C_5$ to $C_{10}$ short chain fatty acids available from Hatco Chemical Corporation under the name of HATCOL 2970 polyol ester.

The present invention requires one to incorporate into the functional fluid as a viscosity index improver from about 0.1 to about 2 parts of a homopolymer polystyrene, per hundred parts of base stock, the homopolymer polystyrene having a molecular weight between about 200,000 and 300,000. Viscosity index improvers are generally long-chain, high molecular weight polymers. The most common viscosity index improvers are methacrylate polymers and copolymers, acrylate polymers, olefin polymers and copolymers, and styrenebutyadiene copolymers. Modified polystyrenes having a molecular weight between 10,000 and 150,000 are sometimes employed as viscosity index improvers, such as the alkylated polystyrene taught by U.S. Pat. No. 2,707,176, which employs a base solution of triarylphosphate and a chlorinated biphenyl. However, the patent teaches that the preferred molecular weight range is between 60,000 and 80,000 as those prepared from a polystyrene having a molecular weight above 80,000 frequently become degraded during use, particularly where the functional fluid is subjected to severe shearing stress. British Pat. No. 951,769 teaches a hydraulic fluid composition employing a triaryl phosphate, such as tricresyl phosphate, and up to 15% by weight of polystyrene having a molecular weight between 10,000 and 100,000. In view of these teachings of the prior art it is suprising that a homopolymer of polystyrene having a molecular weight between 200,000 and 300,000 would function as a viscosity index improver in the base stock of the present invention. One particularly desirable polystyrene has a molecular weight between 235,000 and 245,000 of with a glass transition temperature of 100° C. and is available under the name of STYRON 666D general purpose polystyrene from Dow Chemical Company. To avoid affecting the pour point it is desirable that the polystyrene be added in an amount from about 0.1 part to 1 part per hundred parts of base stock.

As taught by the '309 patent to Dounchis other additives may be incorporated into the base stock, such as very minor amounts, about 0.1% to 5% by weight, of lubricant additives such as rust inhibitors, corrosion inhibitors, anti-foam agents, anti-wear agents, cavitation inhibitors and similar special purpose additives.

A preferred embodiment of the present invention is a hydraulic fluid comprising a base stock consisting of 75 parts by weight DURAD® 150B tertiary-butylphenyl/phenyl phosphate ester 25 parts by weight HATCOL 2970 polyol ester. The base stock is incorporated with 0.5% by weight polystyrene with a molecular weight of from 235,000 to 245,000 and with effective quantities of a copper passivator such as benzotriazole, a rust inhibitor such as a mixed $C_8$ to $C_{12}$ mono and dialkyl acid phosphate, an antioxidant such as 2,6-di-tertiary-butyl-dimethylamino-p-cresol, a silicone antifoam, and an acid acceptor such as 3,4-epoxycyclohexyl-methyl-3,4-epoxycyclohexane carboxylate.

The best mode of practising the present invention will be clear to one skilled in the art from the following nonlimiting examples.

EXAMPLE 1

Preferred Composition

The base stock was prepared by mixing 75 parts by weight DURAD® 150B tertiary-butylphenyl/phenyl phosphate with 25 parts by weight HATCOL 2970 polyol ester at room temperature. The 100 parts by weight of base stock was heated to 121° C. to speed the dissolution of 0.005 parts benzotriazole (a copper passivator), 0.01 parts Ortholeum brand mixed $C_8$–$C_{12}$ alkyl acid orthophosphate (a rust inhibitor), 0.015 parts 2,6-di-t-butyldimethylamino-p-cresol (an anti-oxidant), 0.001 part silicone antifoam and 1 part 3,4-epoxycyclohexyl-methyl-3,4-epoxycyclohexane carboxylate (an acid acceptor). The temperature was reduced to about 100° C. and 0.5 parts of finely ground STYRON® brand polystyrene resin was added slowly with vigorous stirring. After all the resin was dissolved the hydraulic fluid was cooled to room temperature with continued stirring. The properties were determined by standard procedures and the results are listed in Table I.

Table I demonstrates that the composition has excellent shear stability with only a 9.06% drop in viscosity after being subjected to some shear compared with the 15% allowable to pass the test. This is in contrast with the teachings of the prior art that a viscosity improver based on a polystyrene having a molecular weight of above 80,000 frequently becomes degraded when subjected to severe shearing stress. The table further demonstrates the excellent flame retardancy and stability properties required for a hydraulic fluid.

EXAMPLE 2

A series of base stocks were prepared according to Example 1, but employing varying proportions of tertiary-butylphenyl/phenyl phosphate and various polyol esters as indicated in Table II. The additives were also incorporated according to the method of Example 1. Some runs incorporated a commercial viscosity index improver, "R&H", PA 4385 methacrylate polymer as a control. In other runs the high molecular weight polystyrene "Poly S" of the present invention was incorporated. As seen from Table II, it is significant that the high molecular weight polystyrene was effective in producing a viscosity index of over 100 at a use rate of less than 1 part per hundreds parts of base stock. At that use rate the additive had little, if any, adverse effect on the pour point. The commercial Rohm & Haas viscosity index improver, "R&H", required use rates as high as 3 or 4 parts per hundred parts of base stock. Such a high use rate is undesirable as it can adversely affect the flame-retardant properties of the functional fluid composition as well as the thermal and oxidative stability of the base stock. Table II also indicates the high molecular weight polystyrene to be effective at use rates as low as 0.1 part per hundred parts of base stock. Runs 1, 2, 11, 12, 16 and 18 correspond to compositions taught by the '309 patent to Dounchis.

TABLE I

TEST RESULTS OF EXAMPLE I

| Test | Results |
|---|---|
| Kinematic Viscosity 37.8° C. (100° F.) | $37.0 \times 10^{-6} m^2s$ (cts) |
| Kinematic Viscosity 100° C. (212° F.) | $5.68 \times 10^{-6} m^2s$ (cts) |
| Viscosity Index | 101 |
| Pour Point | −31.1° C. (−24° F.) |
| Total Acid No. | 0.05 mg KOH/g |
| Specific Gravity | 1.127 at 20° C. |
| Flash Point, PMCC | 280° C. (536° F.) |
| Autogenous Ignition | 438° C. (820° F.) |
| Moisture Content | 0.04 wt. % |
| Shell 4-Ball Wear Test (ASTM D-2266) 1200 RPM/75° C./40 kg/1 hr. | 0.60 mm Scar Dia. |
| Sonic Shear Stability (ASTM-D2603) | −9.06% |
| Rust Test, Part A | Pass |
| (ASTM-D-665) Part B | Pass |
| Hydrolytic Stability: ASTM-2619 | |
| Cu, wt. loss | 0.025 mg/cm$^2$ |
| Acid No. Increase, Org. layer, | NIL mg KOH/g |
| Total Water Layer Acidity | 1.12 mg KOH |
| Thermal and Oxidative Stability: (FTMS 5308.6) | |
| 72 hrs. at 175° C. w/air purge | Metals Change, mg/cm$^2$ |
| Copper | −0.007 mg |
| Steel | NIL |

TABLE I-continued

| TEST RESULTS OF EXAMPLE I | |
|---|---|
| Test | Results |
| Magnesium | −0.007 |
| Aluminum | −0.022 |
| Silver | −0.015 |
| Total Acid No. After Test | 0.05 mg KOH/g |
| Viscosity at 100° F., After Test | 36.76 cts |
| % Viscosity Change | −0.65% |

Note: English units are enclosed in parentheses

TABLE II

COMPARISON OF EFFICACY OF POLYSTYRENE AND A COMMERCIAL VISCOSITY INDEX IMPROVER

| | BASE STOCK | | | | | | |
|---|---|---|---|---|---|---|---|
| | PARTS | | | Parts Viscosity Index Improver | | Pour Point | |
| RUN | $PO_4$ Ester | Polyol Ester | Polyol Ester Tradename | Poly S | R & H | °C. | V.I. |
| 1 | 85 | 15 | HATCOL 2970 | 0 | 0 | −30 | 56 |
| 2 | 50 | 50 | HERCOLUBE C | 0 | 0 | −43 | 78 |
| 3 | 75 | 25 | HERCOLUBE C | 0 | 3 | −34 | 104 |
| 4 | 75 | 25 | HERCOLUBE C | 0 | 4 | −36 | 102 |
| 5 | 85 | 15 | EMERY 2935 | 0 | 3 | −30 | 106 |
| 6 | 80 | 20 | EMERY 2935 | 0 | 3 | −31 | 106 |
| 7 | 70 | 30 | EMERY 2935 | 0 | 3 | −39 | 117 |
| 8 | 75 | 25 | HERCOLUBE C | 1 | 0 | ND | 129 |
| 9 | 75 | 25 | HERCOLUBE C | 0.5 | 0 | −31 | 108 |
| 10 | 75 | 25 | HERCOLUBE C | 0.5 | 0 | ND | 101 |
| 11 | 85 | 15 | HATCOL 2377 | 0 | 0 | −26 | 48 |
| 12 | 85 | 15 | HATCOL 2925 | 0 | 0 | −32 | 51 |
| 13 | 85 | 15 | HATCOL 2925 | 0.5 | 0 | −31 | 100 |
| 14 | 85 | 15 | HATCOL 2970 | 0.5 | 0 | −29 | 99 |
| 15 | 85 | 15 | HATCOL 2925 | 0.5 | 0 | −30 | 96 |
| 16 | 75 | 25 | HERCOLUBE J | 0 | 0 | ND | 64 |
| 17 | 75 | 25 | HERCOLUBE J | 0.5 | 0 | ND | 106 |
| 18 | 75 | 25 | HERCOLUBE F | 0 | 0 | ND | 82 |
| 19 | 75 | 25 | HERCOLUBE F | 0.1 | 0 | ND | 89 |

Key
ND = not determined
POLY S = homopolymer polystyrene (Inventive Examples)
R & H = Rohm & Haas PA 4835 polymethacrylate viscosity index improver

I claim:

1. A shear-stable hydraulic fluid composition comprising a mixture of a major amount of a tertiary-butylphenyl/phenyl phosphate ester and a minor amount of a polyol ester pour point depressant as a base stock, and from about 0.1% to about 2% of a homopolymer polystyrene having a molecular weight between about 200,000 to about 300,000.

2. The composition of claim 1 wherein the molecular weight of the homopolymer polystyrene is between about 235,000 and 245,000.

3. The composition of clam 1 wherein the polyol ester is an ester of commercial grade pentaerythritol and $C_5$ to $C_{10}$ short chain fatty acids.

4. The composition of claim 2 wherein the polyol ester is an ester of commercial grade pentaerythritol and $C_5$ to $C_{10}$ short chain fatty acids.

5. A shear-stable hydraulic fluid composition comprising a mixture of between 70 parts and 85 parts of a tertiary-butylphenyl/phenyl phosphate ester and between 30 parts and 15 parts of a polyol ester pour point depressant as a base stock, and from about 0.1% to about 1% of a homopolymer polystyrene having a molecular weight of about 200,000 to about 300,000.

6. The composition of claim 5 wherein the molecular weight of the homopolymer polystyrene is between about 235,000 and 245,000.

7. The composition of claim 5 wherein the polyol ester is an ester of commercial grade pentaerythritol and $C_5$ to $C_{10}$ short chain fatty acids.

8. The composition of claim 6 wherein the polyol ester is an ester of commercial grade pentaerythritol and $C_5$ to $C_{10}$ short chain fatty acids.

9. A shear-stable hydraulic fluid composition comprising about 75 parts by weight of a tertiary-butylphenyl/phenyl phosphate and about 25 parts by weight of polyol ester of commercial grade pentaerythritol and $C_5$ to $C_{10}$ mixed fatty acids to form a base stock and about 0.5 parts by weight of a homopolymer of polystyrene having a molecular weight of about 235,000 to 245,000 and an effective quantity of a copper passivator, a rust inhibitor, an anti-oxidant, an antifoam and an acid acceptor.

* * * * *